US005799497A

United States Patent [19]

Sano et al.

[11] Patent Number: 5,799,497

[45] Date of Patent: Sep. 1, 1998

[54] REFRIGERATING APPARATUS

[75] Inventors: Tetsuo Sano, Shizuoka-ken; Yasuhiro Arai; Tetsuji Yamashita, both of Kanagawa-ken; Takaki Iwanaga, Tokyo; Koichi Goto, Kanagawa-ken, all of Japan

[73] Assignee: Kabushiki Kaisha Toshiba, Kawasaki, Japan

[21] Appl. No.: 589,211

[22] Filed: Jan. 22, 1996

Related U.S. Application Data

[63] Continuation of Ser. No. 219,797, Mar. 29, 1994, abandoned.

[30] Foreign Application Priority Data

Mar. 29, 1993 [JP] Japan ..... 5-069667

[51] Int. Cl.[6] ..... F25B 1/00

[52] U.S. Cl. ..... 62/149; 62/502; 62/513

[58] Field of Search ..... 62/114, 149, 174, 62/196.1, 196.2, 228.4, 228.5, 229, 502, 513, 113

[56] References Cited

U.S. PATENT DOCUMENTS

| | | | |
|---|---|---|---|
| 2,938,362 | 5/1960 | Schwind | 62/149 |
| 2,951,349 | 9/1960 | Etherington | 62/149 |
| 2,951,350 | 9/1960 | Etherington et al. | 62/502 X |
| 2,977,773 | 4/1961 | De Kanter | 62/513 X |
| 3,212,284 | 10/1965 | Henderson | 62/513 X |
| 3,668,883 | 6/1972 | Ruff et al. | 62/228.4 X |
| 4,325,224 | 4/1982 | Howland | 62/196.2 |
| 4,718,250 | 1/1988 | Warren | 62/513 X |
| 4,722,195 | 2/1988 | Suzuki et al. | 62/174 X |
| 5,012,651 | 5/1991 | Nakatani et al. | 62/502 X |
| 5,170,636 | 12/1992 | Hitosugi | 62/228.4 X |
| 5,186,012 | 2/1993 | Czachorski et al. | 62/149 X |

FOREIGN PATENT DOCUMENTS

| | | |
|---|---|---|
| 60-142166 | 8/1985 | Japan . |
| 61-066054 | 4/1986 | Japan . |
| 61-099062 | 5/1986 | Japan . |
| 2-25037 | 5/1990 | Japan . |

*Primary Examiner*—Harry B. Tanner
*Attorney, Agent, or Firm*—Foley & Lardner

[57] ABSTRACT

A refrigerating apparatus employs a mixture of coolants and a coolant controller for controlling a ratio between the coolants to adjust refrigerating capacity during a refrigerating operation. The apparatus has a compressor whose revolution speed is controlled to provide required refrigerating capacity. When the revolution speed of the compressor decreases below a lower set value or rises above an upper set value, the coolant controller controls the ratio between the coolants.

22 Claims, 13 Drawing Sheets

REFRIGERATING APPARATUS

This application is a continuation, of application Ser. No. 08/219.797, filed Mar. 29. 1994, now abandoned.

BACKGROUND OF THE INVENTION

1. Field of the Invention

The present invention relates to a refrigerating apparatus employing a mixture of coolants, and particularly, to controlling a ratio between the coolants to adjust the refrigerating capacity of the apparatus.

2. Description of the Prior Art

FIG. 1 shows a standard refrigerating apparatus having a compressor 101, an indoor heat exchanger 103, a pressure reducer 105, and an outdoor heat exchanger 107.

In a refrigerating operation, the indoor heat exchanger 103 serves as an evaporator and the outdoor heat exchanger 107 as a condenser. The compressor 101 discharges a coolant, which flows along dotted arrow marks through the outdoor heat exchanger 107, pressure reducer 105, and indoor heat exchanger 103. The worked coolant returns to the compressor 101.

The refrigerating apparatus of FIG. 1 is of a heat pump type and has a four-way valve 109. To achieve a heating operation, the four-way valve 109 is switched to use the indoor heat exchanger 103 as a condenser and the outdoor heat exchanger 107 as an evaporator. The coolant discharged from the compressor 101 flows along continuous arrow marks through the indoor heat exchanger 103, pressure reducer 105, and outdoor heat exchanger 107. The worked coolant returns to the compressor 101.

The indoor and outdoor heat exchangers 103 and 107 individually serve as the evaporator and condenser depending on the cooling and heating operations. The capacity of the refrigerating apparatus is determined by the capacity of the compressor 101. To increase the capacity of the apparatus, the compressor 101 must be operated at an excessive revolution speed, or must be replaced with a larger one.

If the compressor 101 is operated at the excessive speed, it will cause vibration, friction, and noise and shorten the service life thereof. If the compressor 101 is replaced with a larger one, it will increase the size and weight of the refrigerating apparatus as a whole.

The refrigerating apparatus may employ a mixture of low and high boiling coolants. Compared with the low boiling coolant, the high boiling coolant has a higher boiling point and a higher condensation temperature under the same condensation pressure. Namely, the high boiling coolant is able to send air of higher temperature into a room. Even if the discharge pressure of the compressor 101 is not so high, the high boiling coolant provides high condensation temperature to send air of high temperature into a room, thereby improving the heating capacity of the refrigerating apparatus.

The high boiling coolant, however, has a disadvantage. When ambient temperature is low, the compressor 101 is operated at high speed to increase the circulation quantity of the coolant mixture to increase heating capacity. In this case, the specific volume of the high boiling coolant evaporated in the evaporator (the outdoor heat exchanger 107) becomes very large to increase a pressure loss in suction piping between the evaporator 107 and the compressor 101. Accordingly, the intake quantity of the compressor 101 is not improved even with the increased rotation speed of the compressor 101.

On the other hand, the specific volume of the low boiling coolant evaporated in the evaporator is small. Accordingly, the circulating quantity of the low boiling coolant is large with respect to the same displacement of the compressor 101. This results in improving the efficiency of the heating operation. When the ambient temperature is low to decrease heating capacity, it is advantageous to increase the ratio of the low boiling coolant to the high boiling coolant. The low boiling coolant, however, shows higher condensation pressure under the same condensation temperature, so that, if the low boiling coolant is discharged at high temperature, the discharge pressure of the compressor 101 will exceed a design pressure value.

SUMMARY OF THE INVENTION

An object of the present invention is to provide a refrigerating apparatus that effectively uses the characteristics of a mixture of coolants to improve the performance of a refrigerating operation without employing a large capacity compressor.

In order to accomplish the object, the present invention provides a refrigerating apparatus employing a mixture of coolants and a coolant controller for controlling a ratio between the coolants to adjust refrigerating capacity during a refrigerating operation.

The apparatus has a compressor whose revolution speed is controlled to provide required refrigerating capacity. When the revolution speed of the compressor decreases below a lower set value or rises above an upper set value, the coolant controller controls the ratio between the coolants.

This arrangement effectively operates the compressor from the minimum to maximum capacity thereof.

When the compressor is operated at the minimum capacity, the coolant controller increases the ratio of the high boiling coolant to the low boiling coolant, to increase the specific volume of the coolant mixture. This results in suppressing the capacity of the compressor.

When the compressor is operated at the maximum capacity, the coolant controller increases the ratio of the low boiling coolant to the high boiling coolant, to reduce the specific volume of the coolant mixture. This results in enlarging the capacity of the compressor without employing a large capacity compressor.

These and other objects, features and advantages of the present invention will be more apparent from the following detailed description of preferred embodiments in conjunction with the accompanying drawings.

DETAILED DESCRIPTION OF THE EMBODIMENTS

A refrigerating apparatus according to an embodiment of the present invention will be explained in detail with reference to FIGS. 2 to 9.

Figure 1:
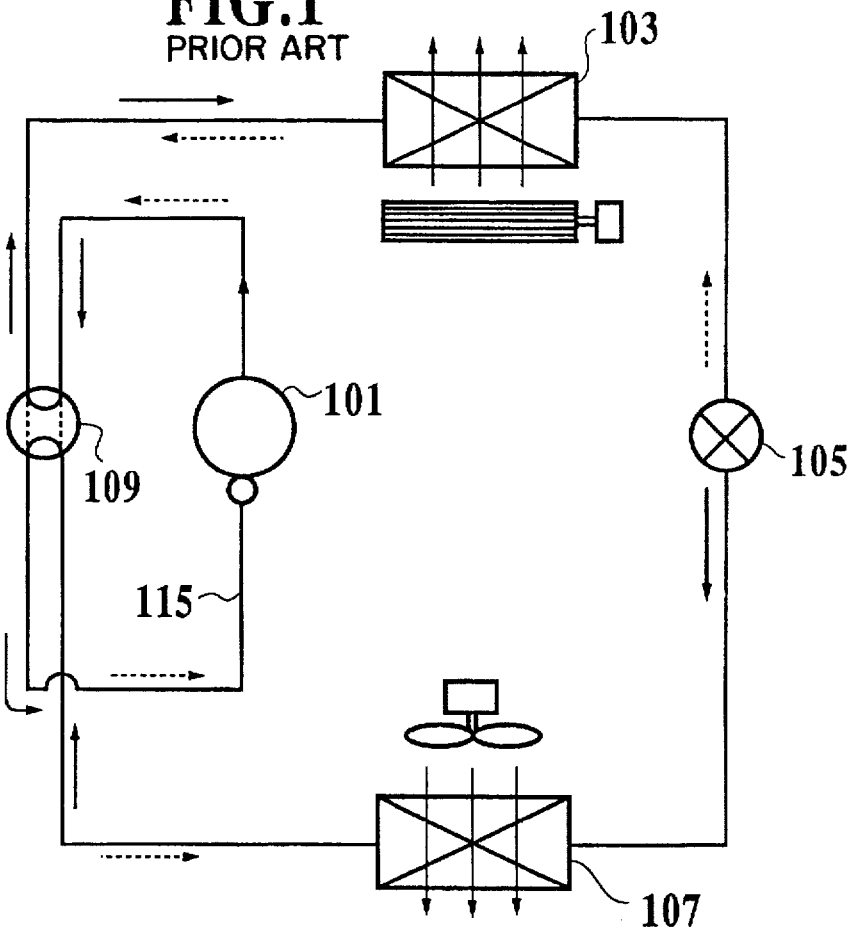
FIG.1 PRIOR ART
FIG. 1 shows a refrigerating apparatus according to a prior art employing a single coolant.
Figure 2:
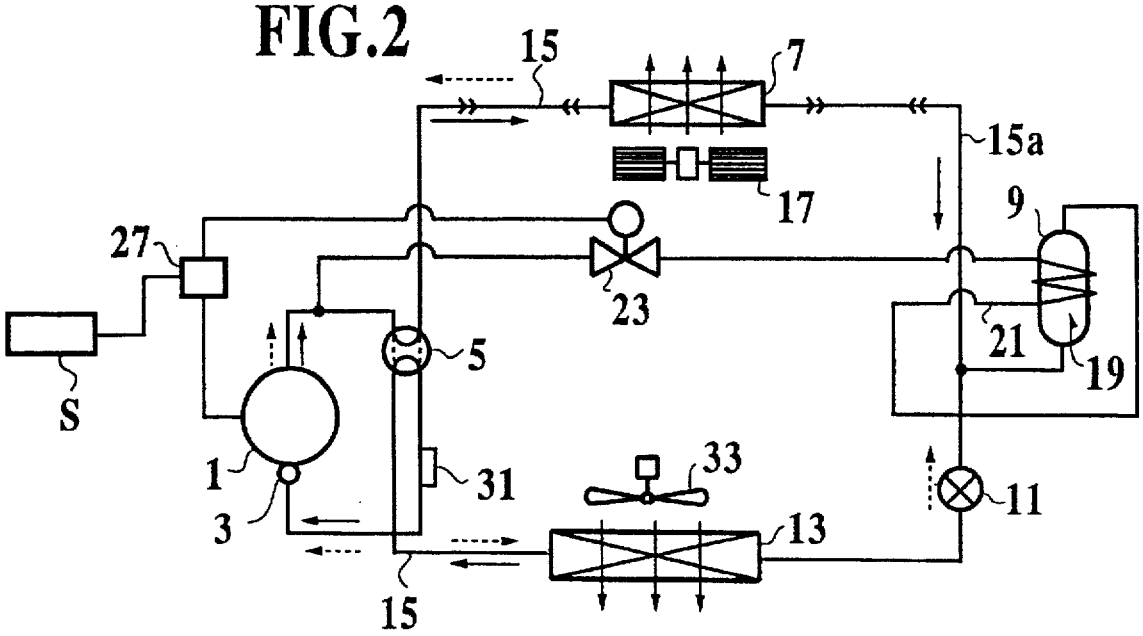
FIG. 2 shows a refrigerating apparatus according to an embodiment of the present invention.

The refrigerating apparatus of FIG. 2 serves as an air pump type air conditioner and employs a mixture of high and low boiling coolants. The refrigerating apparatus includes a compressor 1 having a suction accumalator 3, a four-way valve 5, an indoor heat exchanger 7, a tank 9 serving as a coolant controller, a pressure reducer 11, and an outdoor heat exchanger 13. These components are connected to one another through a coolant pipe 15.

Figure 3:
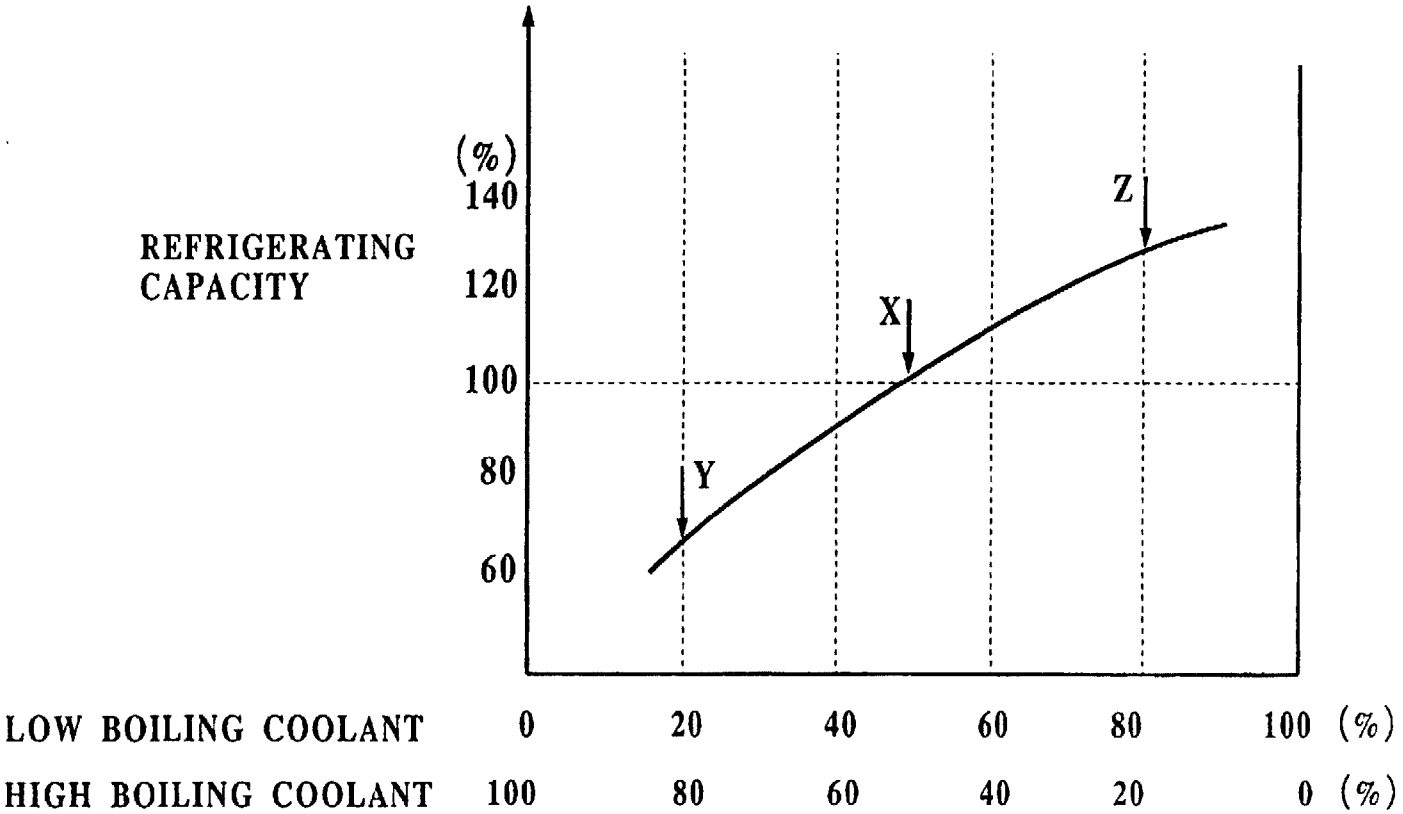
FIG. 3 is a characteristic curve showing a relationship between refrigerating capacity and a ratio between coolants.
Figure 4:
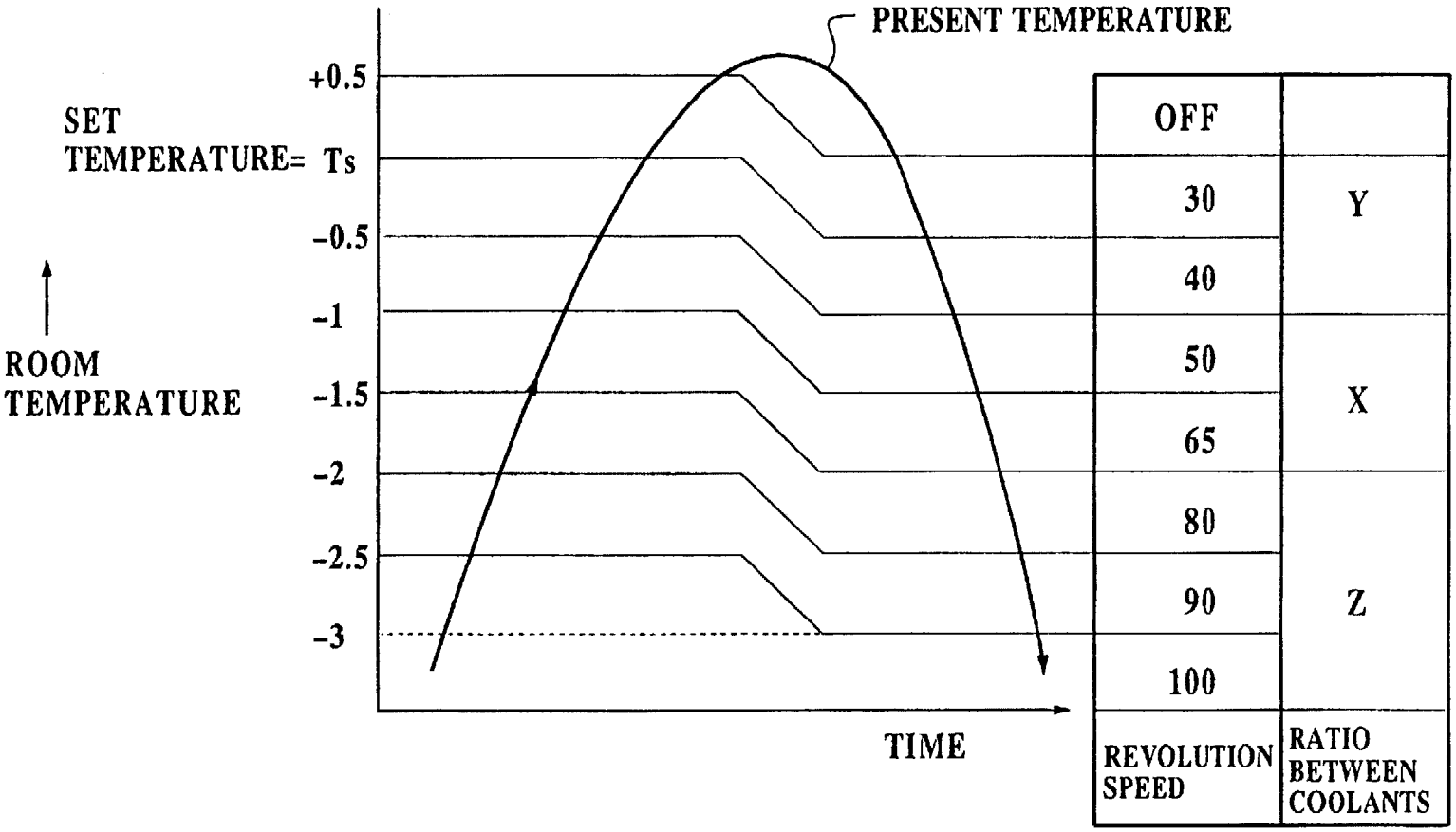
FIG. 4 shows controlled room temperature during a heating operation.

FIG. 3 shows a relationship between refrigerating capacity and a ratio between the coolants. A reference refrigerating capacity of 100% is achieved at a ratio of X of the low boiling coolant to the high boiling coolant. When the ratio of the low boiling coolant to the high boiling coolant is increased into a region Z, the refrigerating capacity improves. On the other hand, the refrigerating capacity drops when the ratio of the low boiling coolant to the high boiling coolant is decreased into a region Y. The coolant mixture according to the embodiment is a non-azeotropic mixture.

Figure 5:
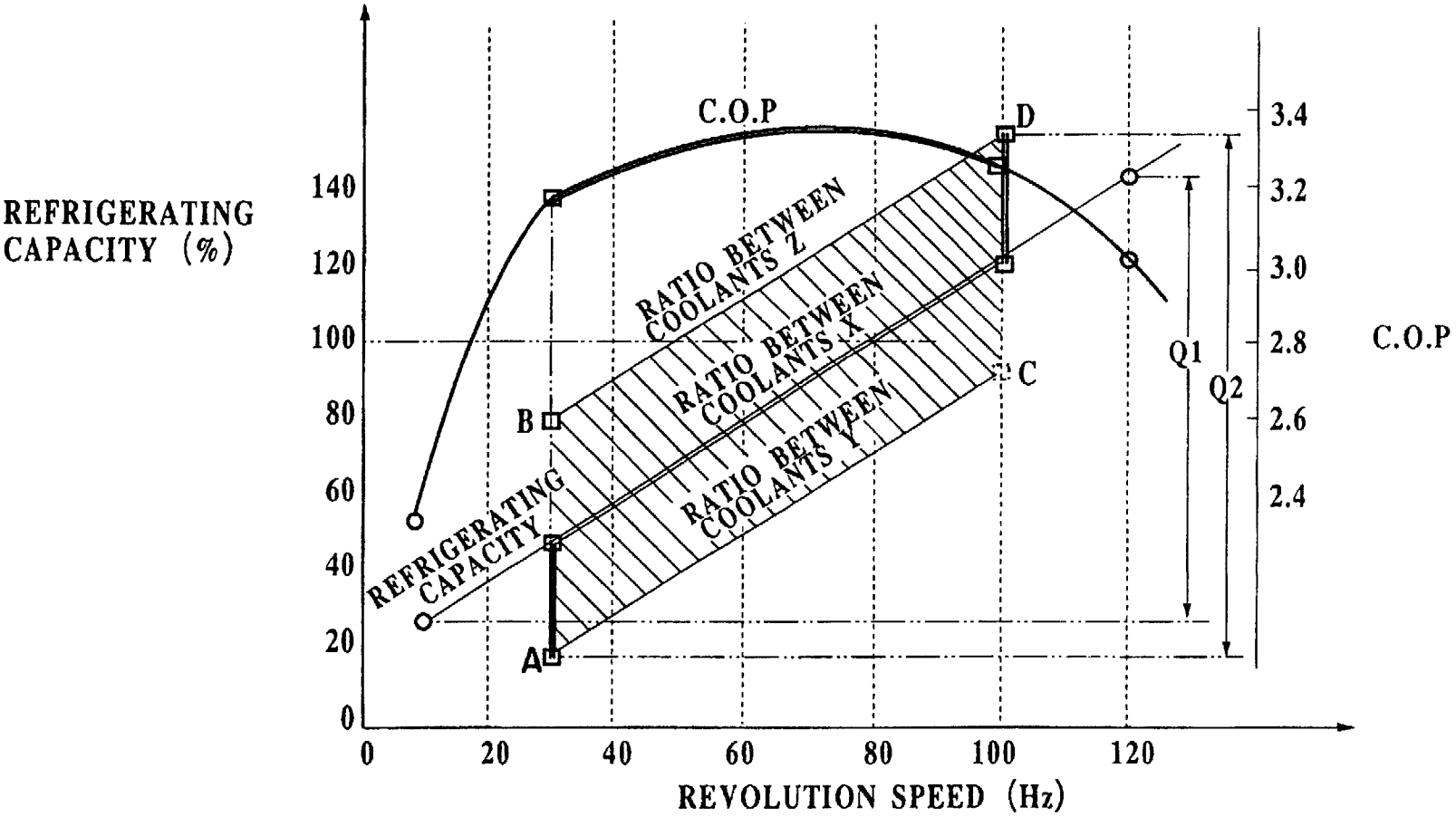
FIG. 5 shows a relationship between revolution speed and refrigerating capacity.

FIG. 5 shows a relationship between the revolution speed of the compressor 1 and refrigerating capacity. According to a difference between a target room temperature and an actual room temperature, the compressor 1 is operated in the range of about 10 to 120 Hz in revolution speed. The compressor 1 receives a gas phase of the coolant mixture from the suction accumalator 3 and discharges a high-temperature high-pressure gas of the coolant mixture.

The four-way valve 5 switches the coolant mixture from the compressor 1 to the indoor heat exchanger 7 or to the outdoor heat exchanger 13.

The indoor heat exchanger 7 serves as an evaporator during a cooling operation and as a condenser during a heating operation.

When the indoor heat exchanger 7 serves as the evaporator, it receives a mist-like low-temperature low-pressure gas of the coolant mixture from the pressure reducer 11. An indoor fan 17 sends air to the indoor heat exchanger 7, so that the coolant in the indoor heat exchanger 7 absorbs latent heat of the air and evaporates to cool the air passing through fins of the indoor heat exchanger 7. The indoor fan 17 sends the cooled air into a room.

When the indoor heat exchanger 7 serves as the condenser, it receives a high-temperature high-pressure gas of the coolant mixture from the compressor 1. The indoor fan 17 sends air to the indoor heat exchanger 7, so that the air absorbs latent heat of the coolant mixture flowing through the indoor heat exchanger 17. As a result, the coolant mixture becomes a mist, and at the same time, the heated air is sent into the room by the indoor fan 17.

The tank 9 is arranged in a path 15*a* for passing a liquid phase of the coolant mixture between the indoor heat exchanger 7 and the pressure reducer 11. The coolant mixture flows into the tank 9 until it is saturated. The coolant in the tank 9 is heated by a coolant heater 19.

The coolant heater 19 has a heat transfer tube 21 for passing the coolant mixture. The tube 21 is wound around the tank 9. An end of the tube 21 is connected to a discharge port of the compressor 1 through a control valve 23. The other end of the tube 21 terminates in the tank 9, which is connected to the coolant pipe 15, i.e., the liquid path 15*a* between the indoor heat exchanger 7 and the pressure reducer 11. The tube 21 passes a high-temperature high-pressure gas of the coolant mixture provided by the compressor 1.

A controller 27 receives a signal from an air-conditioning load sensor S such as a room temperature sensor, to control the operation speed of the compressor 1. The controller 27 also controls the opening of the control valve 23 according to a relationship between the air-conditioning load and the rotation speed of the compressor 1. The controller 27 controls the temperature of the tank 9 between a heating temperature at which the low boiling coolant is vaporized and a heating temperature at which the high boiling coolant is vaporized. Namely, the quantity of the coolant mixture stored in the tank 9 is adjusted to control the ratio between the high and low boiling coolants actually circulating in the refrigerating apparatus.

Figure 8:
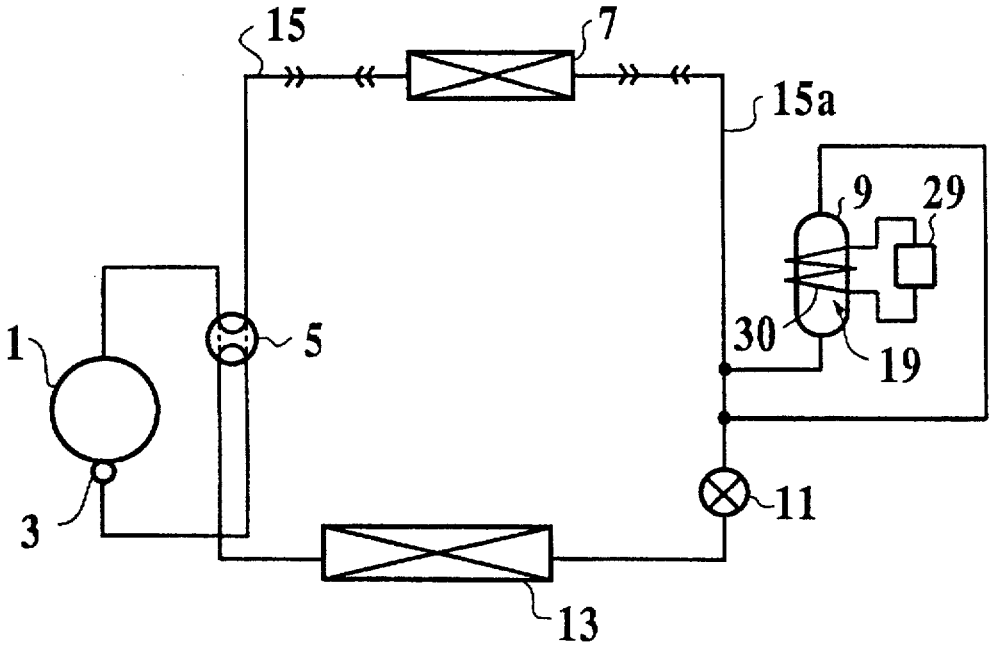
FIG. 8 shows a modification of the refrigerating apparatus of FIG. 2 with a coolant heater having a controller.

FIG. 8 shows a modification of the embodiment of FIG. 2. A coolant heater 30 corresponding to the coolant heater 19 is arranged in the tank 9. The heater 30 is controlled by a controller 29. This modification is capable of correctly controlling the heating temperature of the coolant mixture and providing a required ratio between the high and low boiling coolants from the beginning of the operation of the refrigerating apparatus.

Returning to FIG. 2, the pressure reducer 11 atomizes the coolant mixture into a low-temperature low-pressure mist. The pressure reducer 11 may be operated according to an instruction signal from a coolant temperature sensor 31 arranged on the suction side of the compressor 1. In this case, the pressure reducer 11 adjusts the flow rate of the coolant mixture according to operating conditions such as thermal load.

The outdoor heat exchanger 13 serves as an evaporator during the heating operation and as a condenser during the cooling operation. When the outdoor heat exchanger 13 serves as the evaporator, it receives a mist of the coolant mixture. The mist is evaporated due to heat of air that passes through fins of the outdoor heat exchanger 13. The air is sent outside by an outdoor fan 33.

When the outdoor heat exchanger 13 serves as the condenser, it receives a high-temperature high-pressure gas of the coolant mixture. The outdoor fan 33 sends air to the outdoor heat exchanger 13, and the air absorbs latent heat of the coolant mixture. As a result, the coolant mixture is condensed into a liquid, and the air that has absorbed the latent heat is sent outside by the outdoor fan 33.

During the heating operation in which the indoor heat exchanger 7 serves as the condenser and the outdoor heat exchanger 13 as the evaporator, the coolant mixture discharged from the compressor 1 flows to the indoor heat exchanger 7, pressure reducer 11, outdoor heat exchanger 13, and again the compressor 1. At the start of the heating operation, the ratio between the high and low boiling coolants is an initial one at which the coolants have been sealed in the refrigerating apparatus.

If a difference between a target room temperature TS (FIG. 4) and an actual room temperature becomes large during the heating operation, the controller 27 sends a signal to fully open the control valve 23. As a result, the high-temperature high-pressure coolant gas from the compressor 1 flows through the heat transfer tube 21 to heat the coolant mixture stored in the tank 9.

Due to the heating and inside pressure of the tank 9, the low boiling coolant in the tank 9 evaporates and flows into the pipe 15. This results in increasing the ratio of the high boiling coolant to the low boiling coolant in the tank 9. On the other hand, in the coolant mixture circulating in the refrigerating apparatus, the ratio of the low boiling coolant to the high boiling coolant increases into the region Z (FIGS. 3 and 4) to improve heating capacity.

Then, air that passes through the fins of the indoor heat exchanger 7 serving as the condenser is efficiently heated and supplied as hot air into the room.

The coolant mixture flowing through the outdoor heat exchanger 13 serving as the evaporator absorbs latent heat of the atmosphere that passes through the fins of the outdoor heat exchanger 13. Due to the heat, the coolant mixture in the outdoor heat exchanger 13 changes from a mist into a gas. In this gas, the ratio of the low boiling coolant to the high boiling coolant is large to reduce the specific volume of the evaporated coolant mixture. Namely, the quantity of the coolant mixture relative to the displacement of the compressor 1 becomes larger, to quickly increase the room temperature.

As the actual room temperature approaches the target temperature TS, the temperature difference becomes small to drop the revolution speed of the compressor 1. In response to the revolution speed, the opening of the control valve 23 restricts the flow rate of the high-temperature coolant mixture. As a result, the ratio between the high and low boiling coolants changes from the region X into the region Y (FIGS. 3 and 4), to lower the heating capacity.

During the cooling operation, the indoor heat exchanger 7 serves as the evaporator and the outdoor heat exchanger 13 as the condenser. The compressor 1 draws and compresses the coolant mixture and discharges a high-temperature high-pressure gas of the coolant mixture to the condenser, i.e., the outdoor heat exchanger 13. Latent heat of the coolant mixture is absorbed by the atmosphere that passes through the fins of the outdoor heat exchanger 13, and therefore, the coolant mixture is liquidized.

The liquid coolant mixture flows into the pressure reducer 11 that quickly expands the coolant into a low-temperature low-pressure mist. The mist flows into the evaporator, i.e., the indoor heat exchanger 7 in which the coolant absorbs heat from air that flows through the fins of the indoor heat exchanger 7. As a result, the coolant mist is gasified, and the air is cooled. The cooled air is sent into the room, and the gasified coolant is supplied to the compressor 1. These processes are repeated during the cooling operation.

In the cooling operation, the compressor 1 is operated in the range of 30 to 100 Hz to provide high refrigerating capacity as shown in FIG. 5. When a difference between a target temperature TS and an actual room temperature is large, the controller 27 provides a signal to fully open the control valve 23, so that the heater 19 heats the tank 9. In the tank 9, the ratio of the high boiling coolant to the low boiling coolant increases. On the other hand, in the actually circulating coolant mixture, the ratio of the low boiling coolant to the high boiling coolant increases to enter the region Z.

As the temperature difference becomes small, the ratio between the high and low boiling coolants changes to region X and then to Y in response to the revolution speed of the compressor 1, to reduce the capacity of the compressor 1. As shown in FIG. 5, the present invention operates the refrigerating apparatus with coolant ratios of A, B, C, and D to provide a capacity range of Q2 that is wider than a conventional capacity range of Q1. In this way, the compressor 1 is efficiently operated to reduce power consumption, noise, vibration, and abrasion during the cooling and heating operations.

Figure 6:
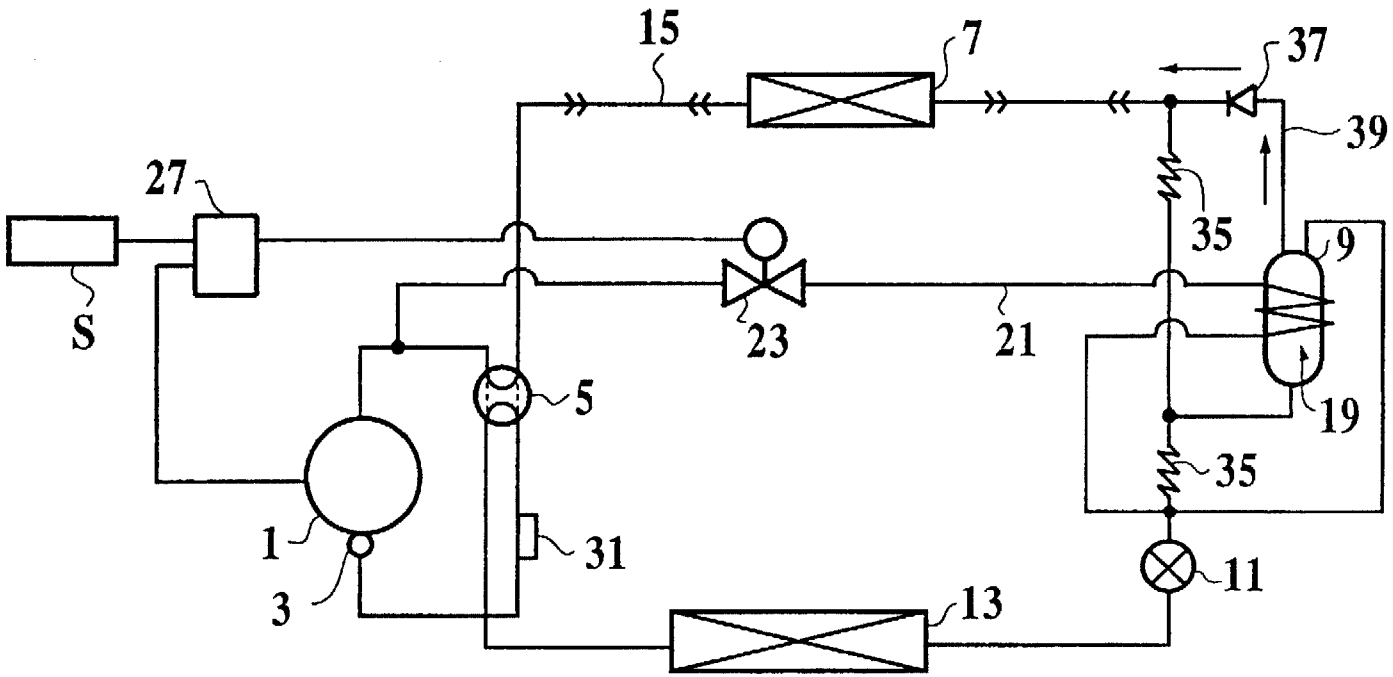
FIG. 6 shows a modification of the refrigerating apparatus of FIG. 2 with capillary tubes being arranged around a tank.

FIG. 6 shows a modification based on the embodiment of FIG. 2. Capillary tubes 35 having different contraction ratios are arranged around the tank 9, to optimize the inside pressure of the tank 9 for the low boiling coolant. From the top of the tank 9, a path 39 extends to the refrigerating cycle. A gasified portion of the coolant mixture in the tank 9 is guided in one direction to the refrigerating cycle through a check valve 37 arranged in the path 39. This arrangement correctly controls the ratio between the high and low boiling coolants in the tank 9 and improves the controllability of the cooling operation.

Figure 7:
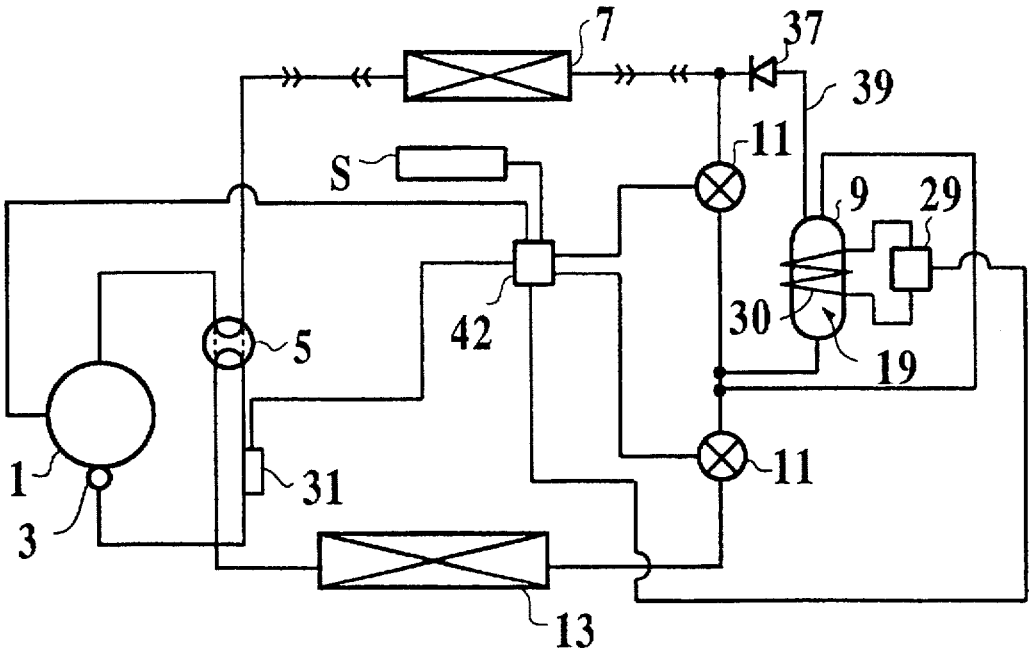
FIG. 7 shows a modification of the refrigerating apparatus of FIG. 2 with pressure reducers being arranged around the tank.

FIG. 7 shows another modification based on the embodiment of FIG. 2. Pressure reducers 11 are arranged before and after the tank 9. A controller 42 controls the pressure reducers 11 in response to air-conditioning load, coolant temperature, or the revolution speed of the compressor 1, to optimize the flow rate of the coolant mixture. A combination of the pressure reducers 11 for controlling the flow rate of the coolant mixture to and from the tank 9 and the heater 19 for heating the coolant mixture in the tank 9 efficiently gasifies the low boiling coolant, correctly controls the quantity of the liquid coolant in the tank 9, and optimizes the ratio between the high and low boiling coolants actually circulating in the refrigerating apparatus according to the operating conditions of the compressor 1.

Figure 9:
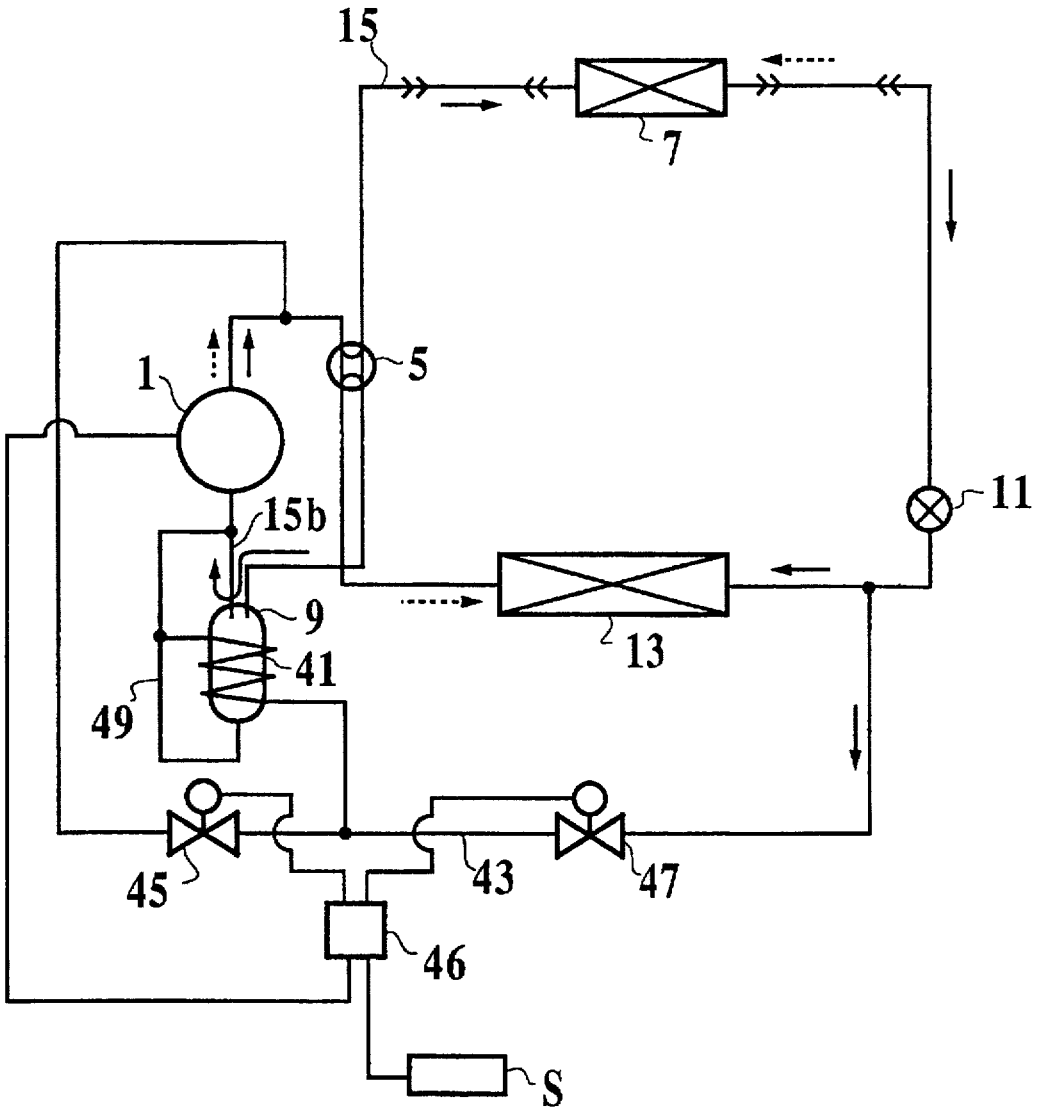
FIG. 9 shows a modification of the refrigerating apparatus of FIG. 2 with the tank being arranged in a path for passing a gas phase of coolants.

FIG. 9 shows another modification based on the embodiment of FIG. 2. The tank 9 is arranged in a path 15*b*, which is positioned on the suction side of the compressor 1 to pass a gas phase of the coolant mixture.

A heat transfer tube 41 is wound around the tank 9. An end of the tube 41 is connected to the suction side of the compressor 1, and the other end thereof is connected to a bypass 43 between a first control valve 45 and a second control valve 47. The end of the tube 41 connected to the suction side of the compressor 1 may be connected to a gas injection pipe extending from the compressor 1.

A controller 46 controls the opening of each of the first and second control valves 45 and 47 in response to the revolution speed or air-conditioning load of the compressor 1. An end of the bypass 43 is connected to the discharge side of the compressor 1, and the other end thereof is connected to piping between the indoor heat exchanger 7 and the outdoor heat exchanger 13.

An oil return pipe 49 returns lubricant from the compressor 1 to the tank 9 when all coolant in the tank 9 is gasified.

During the heating operation, the coolant mixture discharged from the compressor 1 flows along continuous arrow marks through the indoor heat exchanger 7, pressure reducer 11, and outdoor heat exchanger 13, and returns to the compressor 1.

In the heating operation, the second control valve 47 may be opened and the first control valve 45 closed according to the rotation speed or air-conditioning load of the compressor 1, to cool the tank 9 with the coolant gas flowing through the tube 41. This results in accumulating a liquid phase of the high boiling coolant in the tank 9, thereby increasing the ratio of the low boiling coolant to the high boiling coolant in the coolant mixture actually circulating through the refrigerating apparatus.

When the first control valve 45 is opened and the second control valve 47 closed, the high-temperature high-pressure coolant gas from the compressor 1 flows through the tube 41, to heat the tank 9. This results in gasifying all liquid coolant in the tank 9, thereby returning the ratio between the high and low boiling coolants to the initial one at which the coolant mixture has been sealed in the apparatus.

In this way, adjusting the openings of the first and second control valves 45 and 47 achieves an optional intermediate ratio between the high and low boiling coolants.

Figure 10:
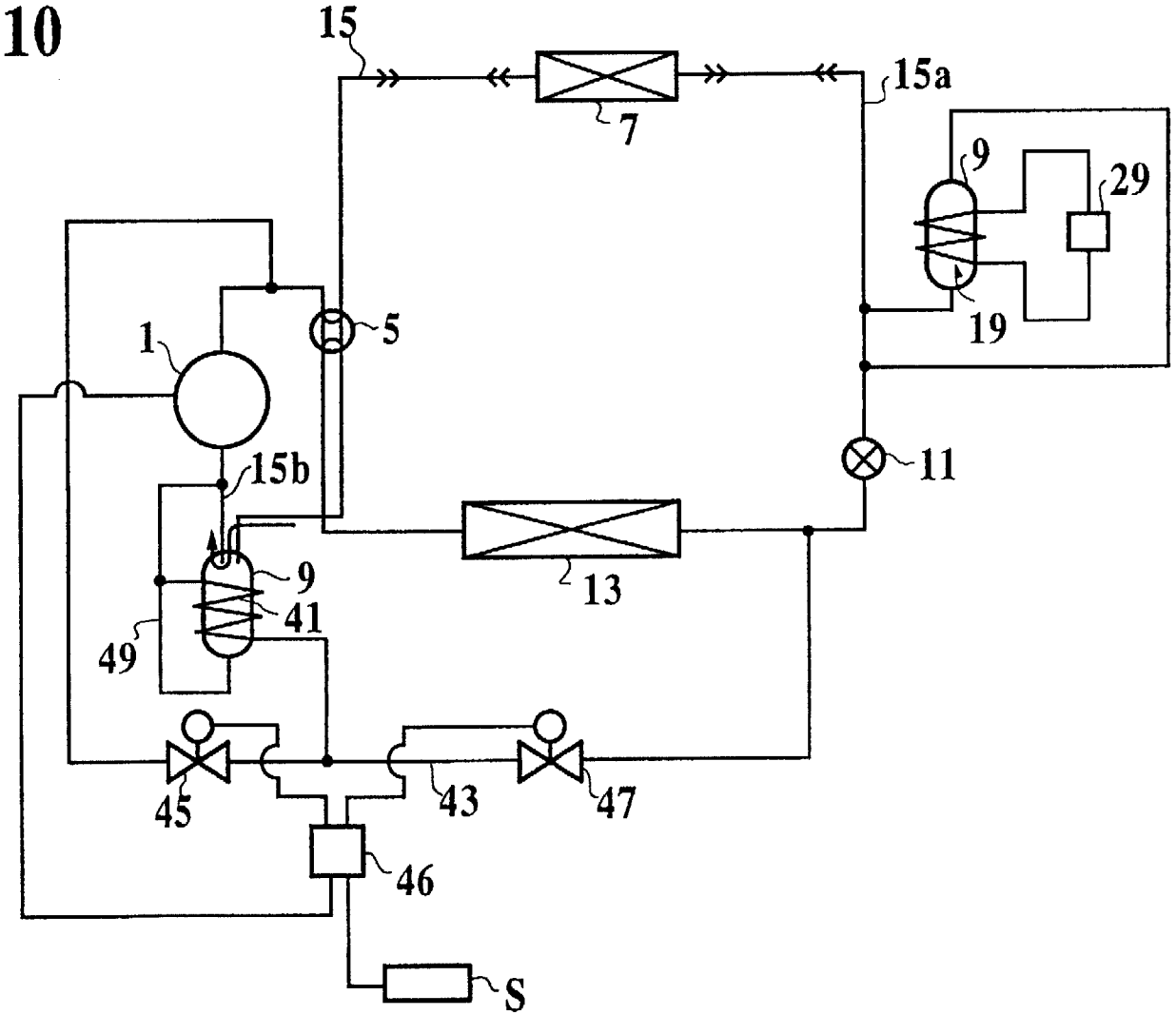
FIG. 10 shows a modification of the refrigerating apparatus of FIG. 2 with tanks being arranged in paths for passing gas and liquid phases of coolants, respectively.

FIG. 10 shows another modification. This is a combination of the arrangements of FIGS. 8 and 9. The arrangement of FIG. 10 is capable of widely controlling the ratio between the high and low boiling coolants according to operating conditions.

Figure 11:
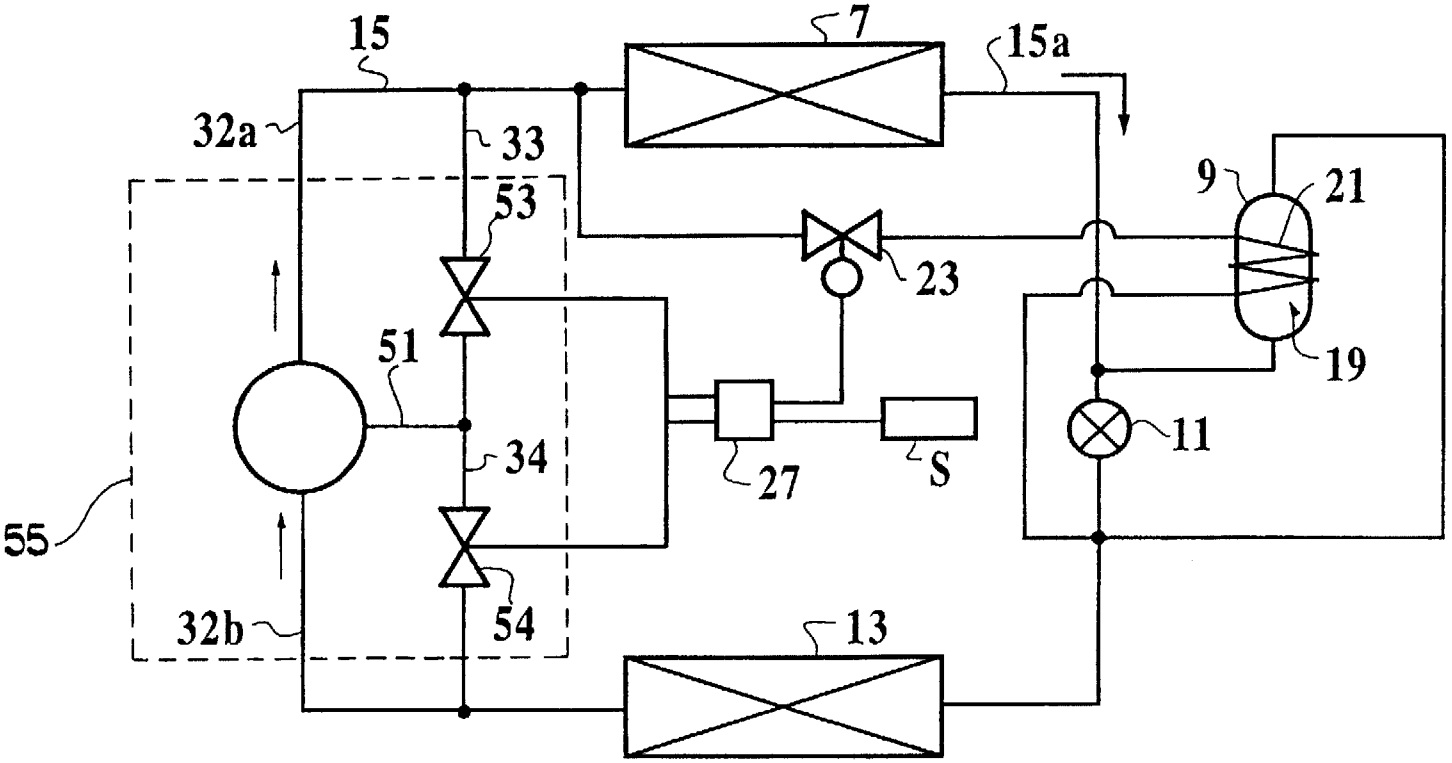
FIG. 11 shows a refrigerating apparatus employing a release type compressor according to the present invention.

FIG. 11 shows a refrigerating apparatus employing a release type compressor 55 according to the present invention.

The compressor 55 has multiple cylinders. Cylinder chambers of the adjacent cylinders of the compressor 55 are connected to each other through a path 51. The path 51 is closed by open/close mechanisms 53 and 54 under a normal operation and is opened by the mechanisms 53 and 54 when the capacity of the compressor 55 drops. In response to the open and close operations of the mechanisms 53 and 54, a tank 9 serving as a coolant controller controls the ratio between high and low boiling coolants circulating in the refrigerating apparatus.

The tank 9 is arranged in a path 15*a* for passing a liquid phase of the coolant mixture between an indoor heat exchanger 7 and a pressure reducer 11. The liquid coolant flows into the tank 9 until it is saturated. The coolant mixture in the tank 9 is heated by a coolant heater 19.

The heater 19 includes a heat transfer tube 21 for passing the coolant mixture. The tube 21 is wound around the tank 9. One end of the tube 21 is connected to a discharge port of the compressor 55 through a control valve 23, and the other end thereof is connected to the path 15*a* of a coolant pipe 15 between the indoor heat exchanger 7 and the pressure reducer 11. A high-temperature high-pressure gas of the coolant mixture from the compressor 55 flows through the tube 21.

A controller 27 receives open/close signals from the open/close mechanisms 53 and 54, and according to these signals, controls the opening of the control valve 23. The controller 27 controls the temperature of the tank 9 between a heating temperature at which the low boiling coolant is vaporized to a heating temperature at which the high boiling coolant is vaporized. Namely, the quantity of the coolant mixture in the tank 9 is adjusted to control the ratio between the high and low boiling coolants circulating through the refrigerating apparatus.

Figure 12:
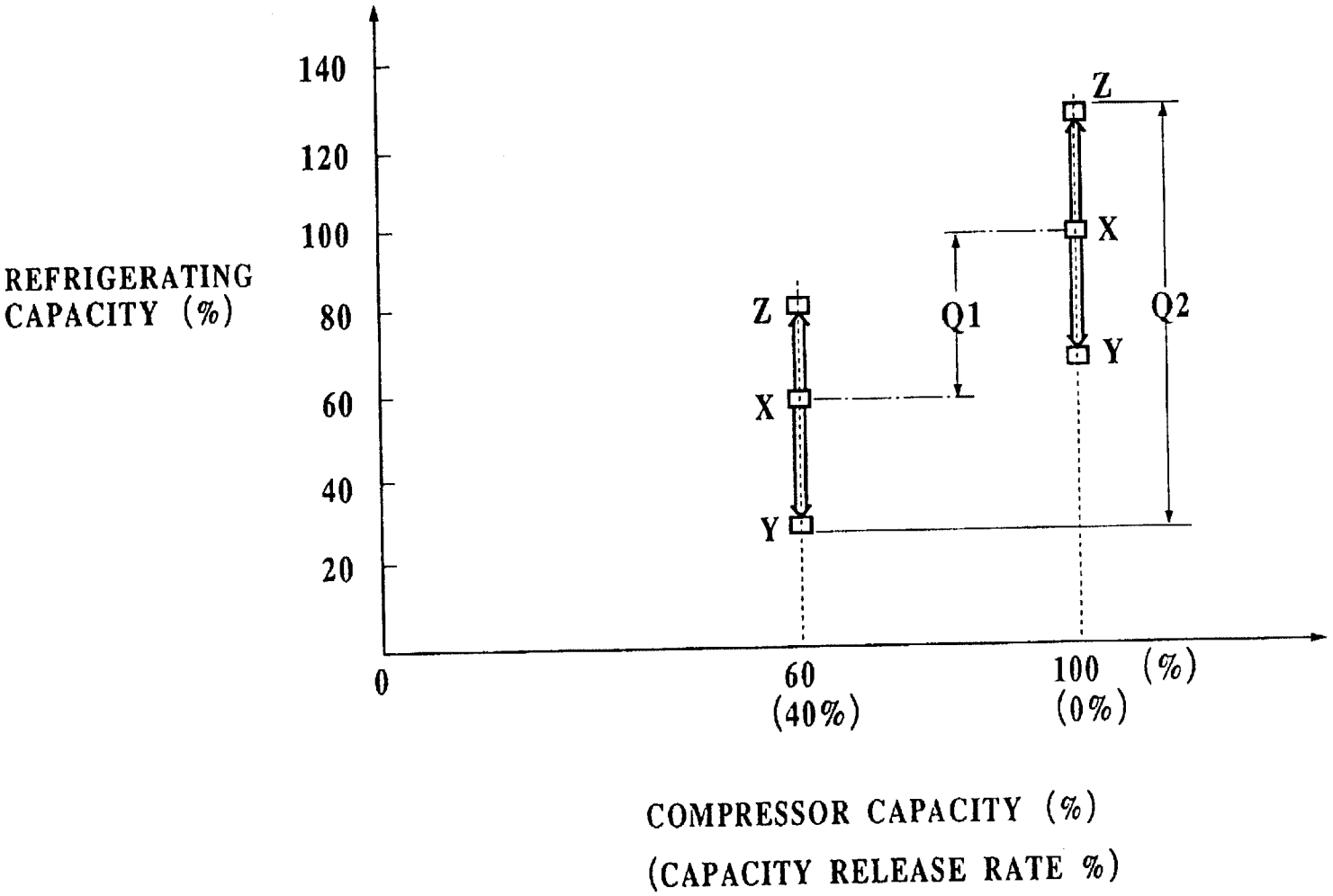
FIG. 12 shows a characteristic curve of the apparatus of FIG. 11.

FIG. 12 shows a comparison between the prior art and the present invention. The prior art has a capacity range of Q1, while the present invention has a capacity range of Q2 that is wider than Q1. The wide capacity range of the present invention is realized by the mixture of coolants and the release type compressor.

Figure 13:
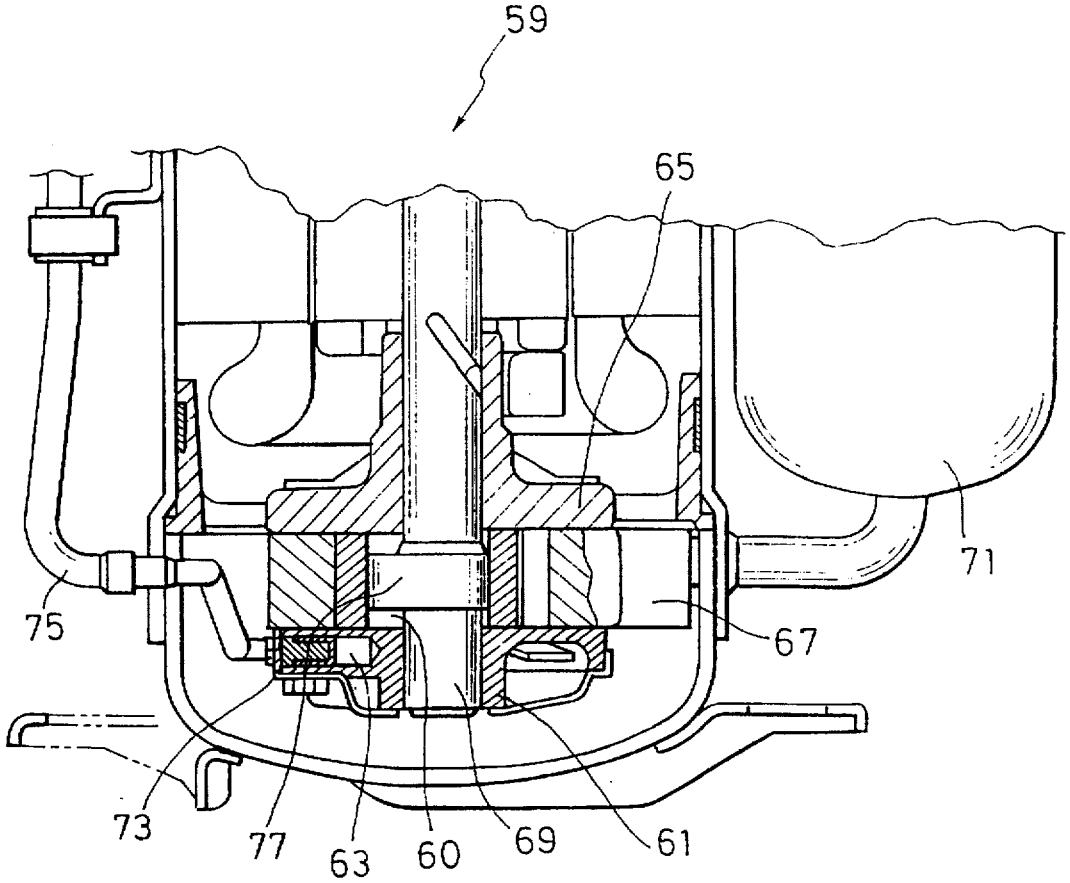
FIG. 13 shows an essential part of a release type compressor according to the present invention.
Figure 14:
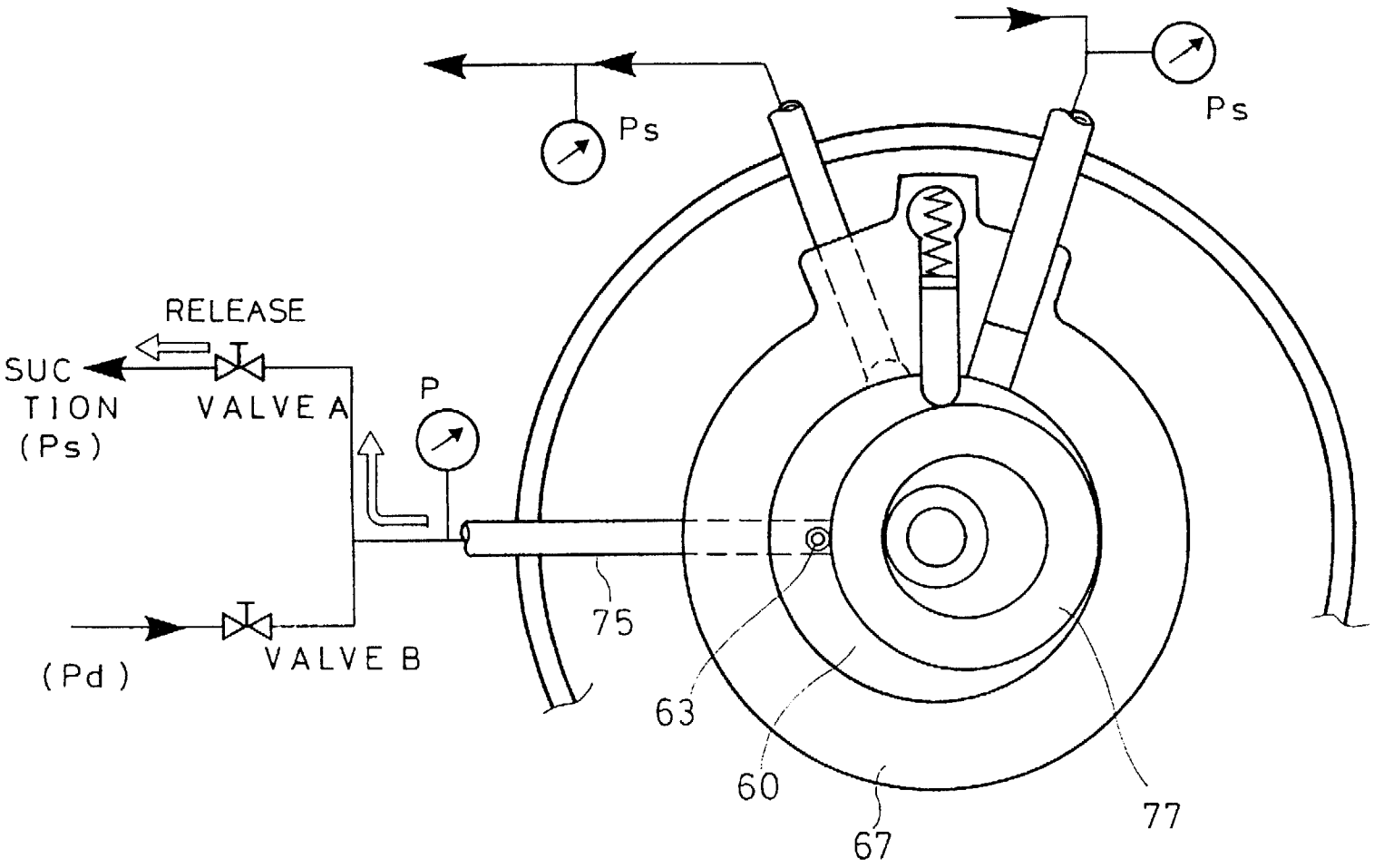
FIG. 14 shows the operation of the compressor of FIG. 13.
Figure 15:
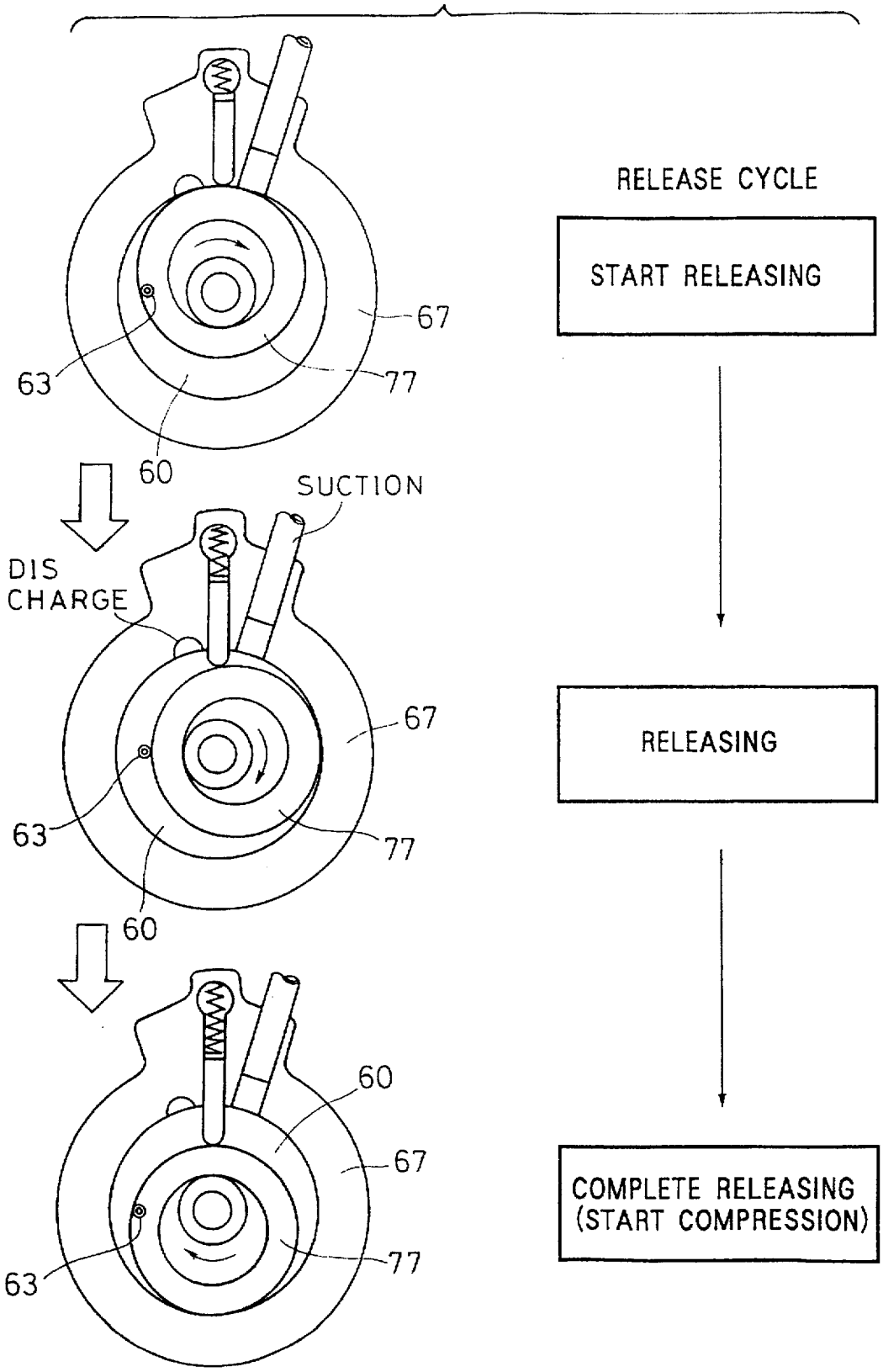
FIG. 15 shows the operation of the compressor of FIG. 13.

FIGS. 13 to 15 show a release type compressor 59 applicable to the refrigerating apparatus of the present invention.

The capacity of the compressor 59 is mechanically adjustable. A combination of the mechanical control of the capacity of the compressor 59 and the control of the ratio between coolants widens a controllable range of the capacity of the refrigerating apparatus.

The compressor 59 has a sub-bearing 61 to form a cylinder chamber 60. The sub-bearing 61 has a release port 63. When the cylinder chamber 60 draws the coolant mixture and compresses the same, a part of the coolant mixture is bypassed to a low pressure side through the release port 63, thereby reducing the capacity of the compressor 59.

The compressor 59 has a frame 65, a cylinder 67, a shaft 69, a suction accumalator 71, a check valve 73, a release pipe 75, and a roller 77.

Operation of the compressor 59 will be explained.

In FIG. 14, the check valve 73 is positioned between the release port 63 and the release pipe 75. When pressure at the release port 63 is higher than pressure in the release pipe 75, i.e., when a valve A is opened and a valve B closed to connect the release pipe 75 to the low pressure side, the coolant mixture is bypassed from the compression chamber 60 to the low pressure side, thereby reducing the quantity of the coolant mixture to be compressed. When the valve A is closed and the valve B opened, the release pipe 75 is connected to the high pressure side. Due to the high pressure, the check valve 73 is closed to bypass no coolant. Accordingly, the compressor 59 provides normal capacity according to the volume of the cylinder.

FIG. 15 shows operations of the release port 63. The roller 77 eccentrically turns. An end face of the roller 77 opens the release port 63 for a given angle of rotation. While the end face of the roller 77 is being out of the release port 63, the coolant mixture is released to the low pressure side. When the end face of the roller 77 closes the release port 63, the coolant mixture is compressed. The release port 63 is not in the compression chamber 60 during the compression period, so that a top clearance volume is secured to efficiently operate the compressor 59.

Although the present invention has been explained with reference to the heat pump type refrigerating apparatus for carrying out cooling and heating operations, the present invention is also applicable to refrigerators and freezers.

In summary, the refrigerating apparatus according to the present invention controls a ratio between component coolants of a coolant mixture, to expand a range between the minimum and maximum heating and cooling capacities. The present invention efficiently uses the coolant mixture in operating a compressor within an efficient operation range, thereby suppressing noise, abrasion, and vibration, and extending service life.

Various modifications will become possible for those skilled in the art after receiving the teachings of the present disclosure without departing from the scope thereof.

What is claimed is:

1. A refrigerating apparatus comprising:

a main passage for circulating a coolant;

a pressure reducer for reducing coolant pressure;

an outdoor heat exchanger;

an indoor heat exchanger connected to said outdoor heat exchanger through said main passage and said pressure reducer;

a compressor connected to said outdoor heat exchanger and said indoor heat exchanger through said main passage for compressing the coolant, which is composed of a mixture of a high boiling coolant and a low boiling coolant, from said indoor heat exchanger or from said outdoor heat exchanger;

a tank connected to said main passage for storing the mixed coolant and for supplying the high boiling coolant and the low boiling coolant therefrom to the coolant circulating through said compressor, said outdoor heat exchanger, and said indoor heat exchanger through said main passage; and a heating line connected to said compressor and wound around said tank to heat said tank with the compressed mixed coolant from said compressor, wherein the heating line has a valve for controlling flow of the compressed mixed coolant through said heating line in accordance with an applied load, wherein said heating line is separate from and bypasses said main passage to adjust the amount of the compressed mixed coolant functioning to heat said tank.

2. The refrigerating apparatus according to claim 1, further comprising a controller for controlling heating of said tank.

3. The refrigerating apparatus according to claim 2, wherein said compressor comprises a multicylinder compressor having a path connecting cylinder chambers of adjacent cylinders to each other and an open/close mechanism for closing the path during a normal operation and opening the path when the capacity of the compressor drops, said controller controlling the heating of said tank according to the open/close operation of the open/close mechanism.

4. The refrigerating apparatus according to claim 2, wherein said controller controls the heating of said tank in response to an air-conditioning load.

5. The refrigerating apparatus according to claim 2, wherein a revolution speed of the compressor is controlled to provide required refrigerating capacity, and wherein said controller controls the heating of said tank when the revolution speed of the compressor is below a lower set value or above an upper set value.

6. The refrigerating apparatus according to claim 1, wherein the coolant is a mixture of non-azeotropic high and low boiling coolants.

7. The refrigerating apparatus according to claim 1, wherein the compressor includes a mechanism for changing a compression capacity of the compressor.

8. The refrigerating apparatus according to claim 1, wherein said compressor comprises at least one cylinder having a path connected to an open/close mechanism for closing the path during a normal operation of said compressor and opening the path when the capacity of the compressor drops.

9. The refrigerating apparatus according to claim 1, wherein the heating line has an end that terminates in the tank.

10. A refrigerating apparatus comprising:

a main passage for circulating a coolant;

a pressure reducer for reducing coolant pressure;

an outdoor heat exchanger;

an indoor heat exchanger operatively connected to said outdoor heat exchanger through said main passage and said pressure reducer;

a compressor operatively connected to said outdoor heat exchanger and said indoor heat exchanger through said main passage for compressing the coolant, which is composed of a mixture of a high boiling coolant and a low boiling coolant from said indoor heat exchanger or from said outdoor heat exchanger;

a tank connected to said main passage for storing the mixed coolant and for supplying the high boiling coolant and the low boiling coolant therefrom to the coolant circulating through said compressor, said outdoor heat exchanger, and said indoor heat exchanger through said main passage; and a heating line connected to said compressor and wound around said tank to heat said tank with the compressed mixed coolant from said compressor, wherein the heating line has a valve for controlling flow of the compressed mixed coolant flowing through said heating line in accordance with an applied load, wherein said heating line is separate from and bypasses said main passage to adjust the amount of the compressed mixed coolant functioning to heat said tank.

11. The refrigerating apparatus according to claim 10, wherein said heating line has an end that terminates in said tank.

12. The refrigerating apparatus according to claim 11, wherein the coolant is a mixture of non-azeotropic high and low boiling coolants.

13. A refrigerating apparatus comprising:

a main passage for circulating a coolant:

an outdoor heat exchanger;

an indoor heat exchanger operatively connected to said outdoor heat exchanger via said main passage;

a compressor operatively connected to said outdoor heat exchanger and said indoor heat exchangers via said main passage;

a tank operatively connected to said main passage for storing the mixed coolant and for supplying coolant circulating through said compressor, said outdoor heat exchanger, and said indoor heat exchanger; and a heating line operatively connected to said compressor and wound around said tank to heat said tank with the compressed mixed coolant from said compressor, wherein the heating line has a valve for controlling flow of the compressed mixed coolant flowing through said heating line in accordance with an applied load, wherein said heating line is separate from and bypasses said main passage to adjust the amount of the compressed mixed coolant functioning to heat said tank.

14. The refrigerating apparatus according to claim 13, wherein said coolant is composed of a mixture of a high boiling coolant and a low boiling coolant, wherein said compressor compresses the coolant circulated through said indoor heat exchanger or through said outdoor heat exchanger.

15. The refrigerating apparatus according to claim 13, wherein a first end of said heating line is connected to a suction side of said compressor.

16. The refrigerating apparatus according to claim 13, wherein said heating line wound around said tank comprises a heat transfer tube.

17. The refrigerating apparatus according to claim 16, wherein said heat transfer tube terminates in said tank.

18. The refrigerating apparatus according to claim 13, wherein the heating line has an end that terminates in the tank.

19. A refrigerating apparatus comprising:

a main passage for circulating a coolant;

an outdoor heat exchanger;

an indoor heat exchanger operatively connected to said outdoor heat exchanger through said main passage;

a compressor operatively connected to said outdoor heat exchanger and said indoor heat exchanger through said main passage for compressing the coolant, which is composed of a mixture of a high boiling coolant and a low boiling coolant from said indoor heat exchanger or from said outdoor heat exchanger;

a tank connected to said main passage for storing the mixed coolant and for supplying the high boiling coolant and the low boiling coolant therefrom to the coolant circulating through said compressor, said outdoor heat exchanger and said indoor heat exchanger; and a heat transfer tube operatively connected to said main passage and wound around said tank to heat said tank with the coolant passing through said compressor, wherein said heat transfer tube is separate from and bypasses said main passage to adjust the amount of the compressed mixed coolant functioning to heat said tank and has a valve for controlling flow of the compressed mixed coolant flowing through the heating line.

20. The refrigerating apparatus according to claim 19, wherein said heat transfer tube is operatively connected to said compressor.

21. The refrigerating apparatus according to claim 19, wherein the heat transfer tube has an end that terminates in the tank.

22. A refrigerating apparatus comprising:

a main passage for circulating a coolant;

a pressure reducer for reducing coolant pressure;

an outdoor heat exchanger;

an indoor heat exchanger operatively connected to the outdoor heat exchanger through the main passage and the pressure reducer;

a compressor operatively connected to the outdoor heat exchanger and the indoor heat exchanger through the main passage for compressing the coolant, which is composed of a mixture of a high boiling coolant and a low boiling coolant, from the indoor heat exchanger or from the outdoor heat exchanger;

a tank connected to the indoor heat exchanger for storing the mixed coolant and for supplying the high boiling coolant and the low boiling coolant therefrom to the coolant circulating through the compressor, the outdoor heat exchanger, and the indoor heat exchanger through the main passage; and a heating line connected to the compressor and wound around the tank to heat the tank with the compressed mixed coolant from the compressor, wherein the heating line has a valve for controlling flow of the compressed mixed coolant flowing through the heating line and has an end that terminates in the tank.

* * * * *